United States Patent [19]

Silvestri, Jr. et al.

[11] Patent Number: 4,811,566

[45] Date of Patent: Mar. 14, 1989

[54] METHOD AND APPARATUS FOR REMOVING MOISTURE FROM TURBINE EXHAUST LINES

[75] Inventors: George J. Silvestri, Jr., Winter Park; Homer G. Hargrove, Maitland, both of Fla.

[73] Assignee: Westinghouse Electric Corp., Pittsburgh, Pa.

[21] Appl. No.: 87,940

[22] Filed: Aug. 21, 1987

[51] Int. Cl.[4] ..... F01K 21/06

[52] U.S. Cl. ..... 60/646; 60/657; 60/679; 55/397

[58] Field of Search ..... 60/646, 657, 663, 679; 55/392, 396, 397

[56] References Cited

U.S. PATENT DOCUMENTS

| | | | |
|---|---|---|---|
| 4,283,206 | 8/1981 | Andro et al. | 55/187 |
| 4,355,515 | 10/1982 | Cohen et al. | 60/657 |
| 4,471,618 | 9/1984 | Tratz et al. | 60/657 |
| 4,527,396 | 7/1985 | Silvestri, Jr. | 60/685 |
| 4,622,819 | 11/1986 | Draper et al. | 60/657 |
| 4,624,111 | 11/1986 | Lang | 60/694 |

FOREIGN PATENT DOCUMENTS 0096916 5/1983 European Pat. Off. .

OTHER PUBLICATIONS von Boeckh et al., "Moisture Separator and Cycle Efficiency Improvements by Installing Moisture Preseparators", 84-JPGC-Pwr-30 (ASME) Joint Power Generation Conference, Toronot, Canada, Oct. 1984.

Senoo et al., "Pressure Recovery of Collectors with Annular Curved Diffusers", 83-GT-35 (ASME) 3/83.

Azzopardi et al., "The Effect of Flow Patterns on Two-Phase Flow in a T Junction," Int. J. Multiphase Flow, vol. 8, No. 5, pp. 491-507, 1982.

*Primary Examiner*—Allen M. Ostrager

[57] ABSTRACT

A method and apparatus for removing liquid entrained by steam flow through crossunder piping in a turbine installation. The apparatus includes an insert, housed within the piping, having a diverging inlet portion and a substantially cylindrical outlet portion of equal inside diameter as the piping. In such manner, the insert and its housing form an annular-shaped collection chamber from which liquid is removed by a drain pipe.

20 Claims, 3 Drawing Sheets

METHOD AND APPARATUS FOR REMOVING MOISTURE FROM TURBINE EXHAUST LINES

BACKGROUND OF THE INVENTION

This invention relates generally to a method and apparatus for removing a liquid from a two-phase flow, and more particularly to the separation of water from a stream of high pressure steam flowing through an exhaust pipe of a high pressure steam turbine.

When a liquid is entrained in a gaseous stream, droplets of that liquid can cause severe erosion within the pipes which carry the gas at high velocities. In a steam turbine system, the problem of pipe erosion is most commonly seen within the pipes which connect the high pressure turbine exhaust to a moisture separator or moisture separator reheater (hereinafter referred to collectively as "moisture separator"). There may be applications where because of space limitations, on warships for example, the high pressure turbine exhaust flow passes directly to the low pressure turbine through crossunder or crossover pipes. Within these pipes, erosion is often most pronounced downstream of where the extraction pipes are joined to crossunder pipes. Such extraction pipes are generally located a short distance below the high pressure turbine exhaust snouts. The erosion of crossunder piping is, therefore, a serious concern to electrical utilities. When pipe erosion causes minor damage, it requires periodic weld repair, mostly in the form of cladding with an erosion resistant material, but, in more severe cases, patches have to be added to the outer surface of the eroded pipes. In some cases replacement of sections or all of the crossunder pipes may be required.

Pipe erosion can be significantly reduced by reducing the amount of entrained moisture in the stream of high pressure steams flowing out of the exhaust snout of the turbine. If entrained moisture is removed from the exhaust steam of the turbine, two important advantages can be realized. The erosion damage to downstream piping can be significantly reduced, and the efficiency of the moisture separator section of the moisture separator reheater may be improved, depending upon its operating effectiveness. In the case of applications where, because of space constraints, there is no moisture separator in the piping between the high pressure and low pressure turbine, application of a moisture separating means according to the teachings of this invention would reduce low pressure turbine inlet moisture and thereby improve turbine efficiency as well as reduce pipe erosion.

One prior art approach for separating liquid from vapor or gas is disclosed in U.S. Pat. No. 4,283,206, issued Aug. 11, 1981 to Andro et al. Dependent upon a despinning action, the apparatus disclosed in Andro et al is comprised generally of an outer vertical tube for admission of a mixture of the vapor or gas and a liquid for separation which mixture is caused to spin and flow downwards. The component further comprises a coaxial inner tube for collecting dry vapor or gas, provided with means for despinning the flow of the dry vapor or gas, the lower edge of the outer tube being at a lower level than that of the upper edge of the inner tube, with orifices being formed in the periphery of the lower edge of the outer tube whose width decreases upwards, and parts for despinning the liquid which drops by gravity along the wall of the outer tube. One problem with the above-described apparatus, however, occurs when water surges and locally high concentrations of moisture form. In such circumstances, the moisture can no longer be separated out to a significant degree. In addition, there are pressure losses resulting from the spinning-despinning.

It is also known from European Patent Application No. 0 096 916 A1, assigned to Brown, Boveri & Cie., to provide in a high-speed water separator, upstream of the deflection blades, a water preseparator which essentially consists of a continuous slit in the wall of the pipe elbow, which slit is overlapped by a cover plate which projects into the flow channel. Although this achieves a separation of the water flowing in the vicinity of the pipe wall, "peeling" of the wall wetness concentration can be only very small if, as intended, only water in laminar flow is to be dealt with.

As is known as well from U.S. Pat. No. 4,527,396, issued on July 9, 1985 to George J. Silvestri, Jr., assigned to the assignee of the present invention and incorporated herein by reference, a moisture separator which incorporates an inner cylinder disposed in coaxial relation with an exhaust pipe of a steam turbine can utilizes the spiral secondary flow of a gas stream to remove liquids which are entrained therein. The moisture separator incorporates an inner cylinder which has one or more apertures through its wall, with the inner cylinder being placed in coaxial relation with the exhaust pipe of a steam turbine with means for sealing the axial ends of an annular chamber formed between the cylinder and the exhaust pipe. Means are provided for dividing the annular chamber into a plurality of arcuate spaces and for removing liquid which collects within each of the arcuate spaces. The moisture separator, thus, utilizes the phenomenon which creates spiral secondary flows when forced to turn around a bend. The spiral flows cause liquid which is entrained in a gas stream, to migrate to the inner surface of a pipe or cylinder and coalesce on the walls thereof. As a result, this moisture separator design utilizes these characteristics of turning streams of gas in order to separate liquid from a moisture-laden gas stream.

Such apparatus, however, is not as efficient as is necessary to remove moisture in the vicinity of a T junction. As is known from P. J. Azzopardi and P. J. Whalley, "The Effect of Flow Patterns on Two-Phase Flow in a T Junction," *International Journal of Multiphase Flow*, Vol, 8, No. 5, pp. 491–507 (1982), a relatively large proportion of water entrained in a two-phase flow of exhaust steam in piping from a turbine can be removed by a side tube, such as an extraction pipe in conventional crossunder piping within a nuclear power plant, when a modest amount of gas flow is extracted. High speed films of such junctions show an area of high entrainment of the liquid into the gas flow just downstream of the side arm. The entrainment from this area occurs in bursts which have a higher frequency than the natural disturbance waves in the main flow. This extra entrainment occurs because of the thickening of the film caused by the gathering of liquid at that point and the locally lower gas velocity. The liquid gathers at that point because the gas entering the side arm drags part of the film around, and not all of this liquid is successful in entering the side arm. The extra entrainment has important implications for the flow in the main tube and any subsequent takeoff point.

In conventional nuclear power plants having dump systems connected to their crossunder piping, however, it has also been noted that the moisture separator reheater immediately preceded by the dump line would have a higher inlet face erosion than one not having the dump line forming a T junction. Such erosion would, thus, be caused by the collection and entrainment of water as observed by Azzopardi et al on the downstream side of the opening for the side tube when the dump system was activated, but also by the side tube's being filled up with water when the dump system was inactive thereby permitting water droplets to be stripped off from the filled side tube by the high velocity steam.

In order to overcome such disadvantages, a still further prior art approach for a preseparator in a steam turbine installation was disclosed in U.S. Pat. No. 4,624,111, issued Nov. 25, 1986 to Helmut V. Lang, which is assigned to BBC Brown, Boveri and Co., Ltd., Baden, Switzerland. The Lang preseparator includes a first internal pipe positioned within an outer pipe so as to form an interspace therebetween and a second internal pipe positioned between the other two pipes so as to divide the interspace int chambers. The first internal pipe forms a constricted passage through the preseparator and its upstream end is spaced from the outer pipe so as to form an annular gap of isokinetic size. As is taught by the Lang patent, a major proportion of the entrained water flows in the vicinity of the wall of the delivery pipe. This preexisting phase separation is exploited at the annular gap, whose dimensioning separates water-laden steam along the walls from the remainder of the working steam. The pipes further cooperate to effect separation of the water from the water-laden steam, with water being evacuated from one of the two interspaced chambers through a first port and steam being evacuated through a second port. The Lang preseparator, however, neglects to utilize the liquid concentrating mechanism of the side tube or extraction pipe and the water build up immediately downstream of the extraction pipe opening. Furthermore, the Lang preseparator necessitates costly and extensive piping modifications in order to be installed within existing systems. For example, a conventional crossunder piping system having two 18-inch diameter extraction pipes must typically be replaced with four 20-inch diameter pipes that are routed to a large tank where the water and steam are separated, the steam going to a feedwater heater and the water being routed to a moisture separator reheater drain tank or discharge line. Because of such extensive piping modifications and tankage, installation of the Lang preseparator often requires two nuclear plant refueling outages to be completed. Moreover, as a result of not only the reduction of the internal flow area in the Lang preseparator, but also the less than ideal contours of its insert, a conventional nuclear power plant which utilizes such preseparators will incur a loss of power output due to an increase in the pressure drop experienced within the crossunder piping.

SUMMARY OF THE INVENTION

Accordingly, it is a general object of the present invention to provide an improved method and apparatus for removing water from a moisture laden flow of steam. More specifically, it is an object of the present invention to provide an in-line crossunder pipe moisture catcher which utilizes the liquid concentrating mechanism of the side tube, such as an extraction pipe, in a T junction.

It is another object of the present invention to provide a moisture separating method and apparatus in a nuclear power plant which minimizes downtime experienced during fuel outages for the installation of such devices.

Still another object of the present invention is to provide a moisture separating method and apparatus capable of removing water from a moisture-laden flow of steam from a turbine exhaust chamber.

Briefly, these and other objects of the present invention are accomplished in a high-pressure steam turbine having an exhaust snout connected by crossunder piping of a first predetermined inside diameter to a moisture separator wherein a two-phase flow of exhaust steam from the turbine creates a localized area of liquid entrainment within the piping, such apparatus comprising generally a tubular means for catching the entrained liquid, the tubular means including a diverging inlet portion and a substantially cylindrical outlet portion, means for housing the tubular means within the piping, the housing means having a second predetermined inside diameter greater than the first predetermined inside diameter thereby creating an annular-shaped collection chamber, and means for draining the collection chamber. In those installations where a T junction is formed between the crossunder piping and an extraction pipe, the apparatus in accordance with one important aspect of the present invention is positioned immediately downstream of the T junction, thereby utilizing the liquid concentrating mechanism of the extraction pipe, as well as eliminating the water buildup just below the downstream edge of the extraction pipe opening. In accordance with another important aspect of the invention such apparatus may also be utilized in crossunder piping having no extraction pipes by utilizing the concentrating action and water droplet agglomerating action of the vortex that extends down the crossunder piping from the turbine exhaust chamber. Accordingly, such apparatus would be installed within the crossunder piping at a position where the vortex substantially loses its effectiveness in depositing water droplets upon the wall of the crossunder piping.

These and other objects, advantages and novel features of the present invention will become more apparent from the following detailed description of a the invention when considered in conjunction with the accompanying drawings wherein:

DETAILED DESCRIPTION OF THE INVENTION

Figure 1:
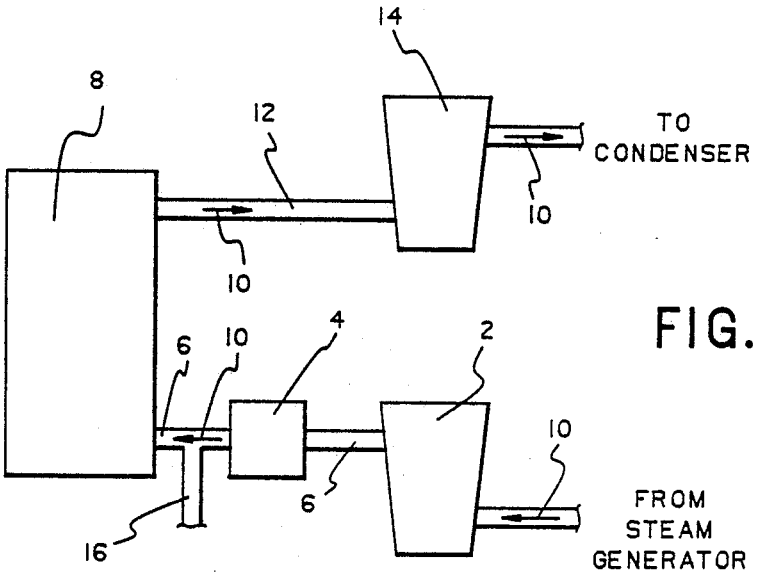
FIG. 1 diagrammatically illustrates a conventional steam turbine arrangement having installed moisture separators including one constructed in accordance with the present invention.

Referring now to the drawings, wherein like characters designate like or corresponding parts throughout the several views, there is shown in FIG. 1 a conventional steam turbine installation having the requirement for water separation. Steam issuing from a high-pressure steam turbine 2 first flows through a conventional preseparator 4 placed immediately downstream of the turbine 2. The steam then flows typically through crossunder piping 6, to a moisture separator 8. As is conventional, a steam path 10 indicated by the arrows that enters the turbine 2, such as from a steam generator (not shown) leaves the turbine 2 through the crossunder piping 6, to the MSR 8, and passes through crossover piping 12 from the MSR 8 to a low-pressure steam turbine 14 from which it exits and may be recirculated through the steam generator via the condenser (not shown). The crossunder piping 6, as is known, typically includes extraction piping 16 forming a T junction therewith.

Figure 2A:
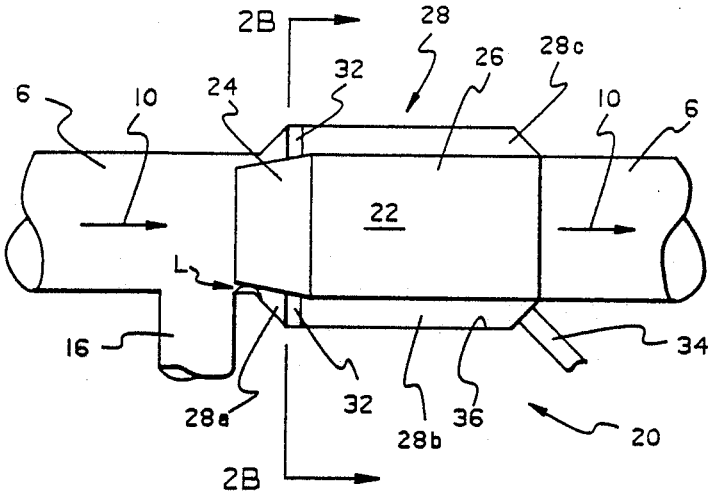
FIGS. 2A and 2B shows one embodiment of the in-line crossunder pipe moisture catcher according to the present invention.
Figure 2B:
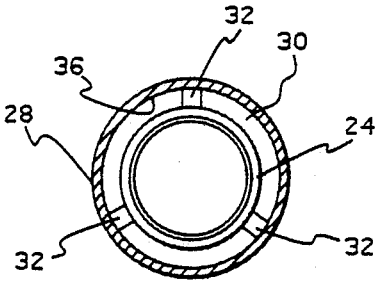

One means of removing moisture from the steam path 10 at such T junctions is shown in FIGS. 2A and 2B. According to this first embodiment of the present invention, an in-line crossunder piping moisture catcher 20 is positioned immediately downstream of the T junction formed by the intersection of the crossunder piping 6 and its extraction piping 16. The moisture catcher 20 is comprised generally of tubular means 22 for catching the entrained liquid L, the tubular means 22 including a diverging inlet portion 24 and a substantially cylindrical outlet portion 26. The tubular means 22 utilizes the liquid concentrating mechanism of the extraction piping 16 and the water buildup L just below the downstream edge of the opening of the extraction piping 16. As such, moderately sized water droplets not captured by the preseparator 4, as well as those that are slung onto the walls of the crossunder piping 6 by a vortex V formed in the exhaust chamber of the high-pressure steam turbine 2 as will be explained in greater detail herein below, are captured by the moisture catcher 20.

The tubular means 22, according to one important aspect of the present invention, is housed within housing means 28 having a second predetermined inside diameter greater than the first predetermined inside diameter thereby creating an annular-shaped collection chamber 30. The housing means includes a conically-shaped upstream portion 28*a* which diverges from the first predetermined inside diameter to the second predetermined inside diameter, a substantially cylindrical middle portion 28*b*, and a downstream end portion 28*c* which converges from the second predetermined inside diameter to the piping 6 thereby enclosing the chamber 30. Means 32 for supporting the tubular means 22 within the housing means 28, such as stiffeners are disposed radially about the tubular means 22. The collection chamber 30 is closed as shown at a downstream end thereof, and includes drain means 34 such as a small pipe for removing the entrained liquid L.

According to another important aspect of the present invention, the substantially cylindrical outlet portion 26 of the tubular means 22 is sized so as to be substantially equal in dimensions to the crossunder piping 6. As such, the diverging inlet portion 24 promotes collection of the entrained liquid L from the downstream edge of the extraction piping 16, the entrained liquid L thereafter being collected upon an inner wall 36 of the collection chamber 30, draining down by gravity to the bottom of the collection chamber 30, and out through the drain means 34. When the crossunder piping 6 has a horizontal orientation and the extraction pipe 16 is oriented vertically downward, the water would drain by gravity along the inner surface of the diverging section of the lower half of the housing means 28. In this instance the drain pipe 34 would be located on the lowest point of the cylindrical section of housing means 28. As a result, the tubular means 22 provides no substantial reduction in flow through the crossunder piping 6, thereby minimizing increases in pressure drops experienced through the crossunder piping 8 and maximizing power output. Model tests have shown a strong interaction between the exhaust chamber vortices V (FIG. 3) and the flow adjacent to the outlet pipes in the base resulting in a locally concentrated rivulet of water. Differently shaped exhaust chambers and exhaust snout configurations result in a different location of this rivulet Accordingly, the gap between the crossunder piping 6 and the diverging inlet portion 44 must be adequately sized to accommodate local variations in water concentration.

Figure 3:
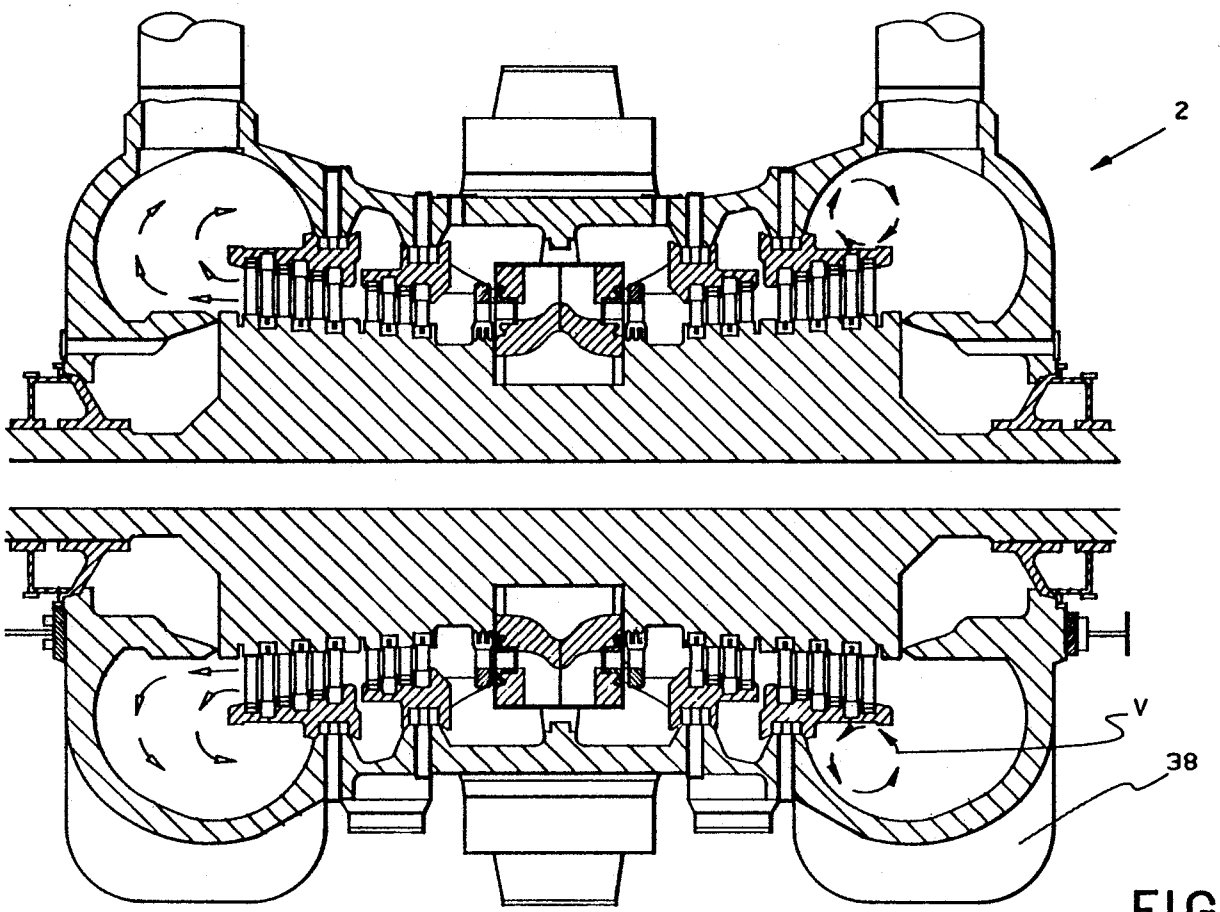
FIG. 3 illustrates in sectional view a typical steam turbine with a vortex formed in its exhaust snout.
Figure 4A:
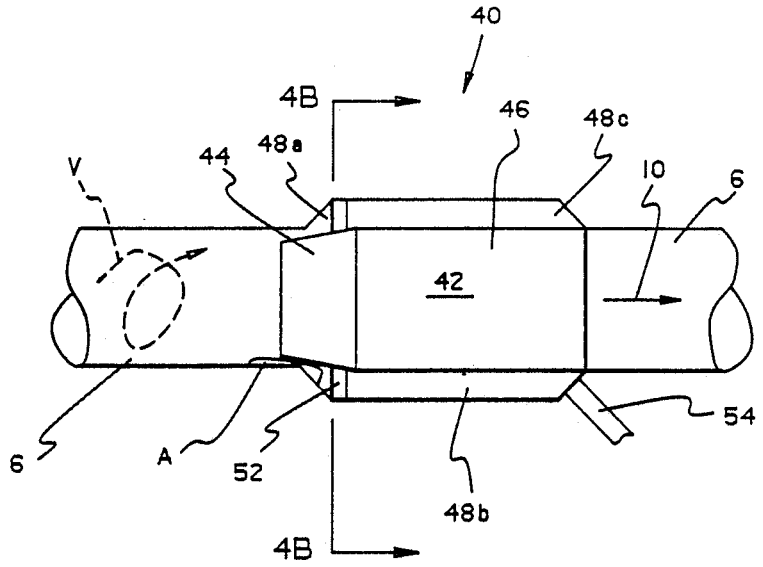
FIGS. 4A and 4B illustrates a second embodiment of the in-line crossunder pipe moisture catcher according to the present invention.
Figure 4B:
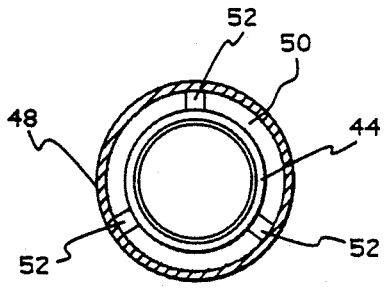

Referring now to FIG. 3, there is shown a longitudinal sectional view of a conventional high-pressure steam turbine 2 with vortices V shown in the vicinity of its exhaust snouts 38. Such vortices V extend down through the exhaust snout 38 into the crossunder piping 6, slinging water droplets onto the walls of the crossunder piping 8. In accordance with yet another important aspect of the present invention, and referring now to FIG. 4A and 4B, a second embodiment of an in-line crossunder moisture catcher 40 is shown. As is shown therein, the crossunder piping 6 does not include extraction piping 18. Therefore, the liquid concentrating mechanism of the side tube in a T junction is not present. The vortex V which extends into the crossunder piping 8 from the exhaust snout 38, however, creates an agglomeration of water droplets A in the vicinity of that point within the crossunder piping 6 where the vortex V looses its effectiveness. As a result, more water is deposited on the walls of the crossunder piping 6 than is typical in two-phase annular flow, such agglomeration A being advantageously removed by the in-line crossunder piping moisture catcher 40. The moisture catcher 40, like the moisture catcher 20 described with reference to FIGS. 2A and 2B, includes tubular means 42 having a diverging inlet portion 44 and a substantially cylindrical outlet portion 46, housing means 48*a*–48*c* having a second predetermined inside diameter greater than the first predetermined inside diameter of the crossunder piping 6, thereby creating an annular-shaped collection chamber 50. The moisture catcher 40 further includes support means 52, such as stiffeners, and a drain means 54 similar to the piping described with reference to the drain means 34 of FIGS. 2A and 2B. Moisture deposited by the vortex V is skimmed off by the tubular means 42 being placed with its diverging inlet portion 44 located immediately adjacent that point within the crossunder piping 6 where the vortex V has lost its effectiveness. Optimum location of the tubular means 40 is, of course, dependent upon a determination of the point at which the vortex V has lost its effectiveness, such determination being conventionally made through flow visualization tests.

Placement of such tubular means 22 and 42 within the crossunder piping 6 of a nuclear power plant would thus capture and remove the moderately-sized water droplets that had not been captured by the preseparator 4, as well as the water droplets that are slung onto the walls of the crossunder piping 6 by the vortex V emanating from the exhaust snout 38 of the high-pressure steam turbine 2. Obviously, many modifications and variations of the present invention are possible in light of the above teachings. It is therefore to be understood that within the scope of the appended claims, the invention may be practiced otherwise than as specifically described.

I claim as my invention:

1. In a high pressure steam turbine having an exhaust chamber including a snout connected by crossunder piping of a first predetermined inside diameter to a moisture separator, wherein a two-phase vortical flow of exhaust steam from the exhaust chamber of the turbine creates a localized area of liquid entrainment within the piping, apparatus for removing the entrained liquid from the area comprising:

tubular means for catching the entrained liquid at the localized area, said tubular means including a diverging inlet portion and a substantially cylindrical outlet portion;

means for housing said tubular means within the piping, said housing means having a second predetermined inside diameter greater than said first predetermined inside diameter thereby creating an annular-shaped collection chamber between said tubular means and said housing means, said collection chamber at said inlet portion of said tubular means being disposed at a point within the piping where the vortical flow substantially loses its effectiveness; and means for draining said collection chamber.

2. The apparatus according to claim 1, wherein said inlet portion is disposed adjacent to the localized area.

3. The apparatus according to claim 1, further comprising an extraction pipe right angularly connected to the crossunder piping immediately upstream of said tubular means.

4. The apparatus according to claim 3, wherein said extraction pipe is right angularly connected to the crossunder piping.

5. The apparatus according to claim 3, wherein said extraction pipe comprises tubing having an inside diameter less than the first predetermined inside diameter.

6. The apparatus according to claim 5, wherein said outlet portion comprises tubing having an outside diameter less than said second predetermined inside diameter, and an outside diameter substantially equal to the first predetermined inside diameter.

7. The apparatus according to claim 1, wherein said housing means comprises:

a conical upstream portion connected to the crossunder piping, said upstream portion diverging from the first predetermined inside diameter to said second predetermined inside diameter;

a substantially cylindrical middle portion, connected to said upstream portion, having an inner wall surrounding said collection chamber; and a downstream end portion connected to said middle portion and the crossunder piping thereby enclosing said collection chamber at a downstream end thereof.

8. The apparatus according to claim 7, further comprising a plurality of stiffeners radially disposed within said collection chamber and connecting said tubular means to said middle portion.

9. Apparatus for preventing erosion of piping in a steam path of a nuclear power plant, comprising:

steam generating means for supplying a flow of moisture-laden steam;

a steam turbine including an exhaust chamber with a snout, said steam turbine receiving said flow for generation of power and thereafter exhausting said flow vortically through said snout;

crossunder piping of a first predetermined inside diameter connecting said snout and said moisture separator reheater;

means for catching water droplets in said exhausted vortical flow upstream of said moisture separator reheater at a point within said piping where said vortical flow substantially loses its effectiveness; and means for recirculating said exhausted follow to said steam generator means.

10. The apparatus according to claim 9, wherein said steam turbine creates a vortex within said exhaust chamber, said vortex extending a predetermined distance into said crossunder piping.

11. The apparatus according to claim 10, wherein said catching means comprises:

a tubular insert having a diverging inlet portion and a substantially cylindrical outlet portion;

means for housing said insert coaxially within said crossunder piping, said housing means having a second predetermined inside diameter greater than said first predetermined inside diameter thereby creating an annular-shaped collection chamber between said insert and said housing means; and means for draining said collection chamber.

12. The apparatus according to claim 11, wherein said inlet portion is disposed adjacent to said predetermined distance.

13. The apparatus according to claim 12, wherein said outlet portion comprises tubing having an outside diameter less than said second predetermined inside diameter, and an outside diameter substantially equal to said first predetermined inside diameter.

14. The apparatus according to claim 9, wherein said housing means comprises:

a conical upstream portion connected to the crossunder piping, said upstream portion diverging from the first predetermined inside diameter to said second predetermined inside diameter;

a substantially cylindrical middle portion, connected to said upstream portion, having an inner wall surrounding said collection chamber; and a downstream end portion connected to said middle portion and the crossunder piping thereby enclosing said collection chamber at a downstream end thereof.

15. The apparatus according to claim 14, further comprising a plurality of stiffeners radially disposed within said collection chamber and connecting said insert at its inlet portion to said middle portion.

16. In combination with a nuclear power plant, the apparatus according to claim 11.

17. In a nuclear power plant having a steam turbine with an exhaust snout connected by crossunder piping of a first predetermined inside diameter to a moisture separator reheater, wherein a two-phase vortical flow of steam exhausted by the turbine creates a localized area of liquid entrainment within the piping, a method of removing the entrained liquid from the area comprising the steps of:

providing a tubular insert having a diverging inlet portion and a substantially cylindrical outlet portion with an inside diameter equal to the first predetermined inside diameter;

housing said insert coaxially within the piping, at a point therein where the vortical flow substantially loses its effectiveness, by means having a second predetermined inside diameter, greater than the first predetermined inside diameter, thereby creating an annular-shaped collection chamber; and draining said collection chamber.

18. The method according to claim 17, wherein said housing step comprises:

forming a conical upstream portion which diverges from the first predetermined inside diameter to said second predetermined inside diameter;

connecting said upstream portion to the piping;

forming a substantially cylindrical middle portion having an inner wall adapted to surround said collection chamber;

connecting said middle portion to said upstream portion;

forming a downstream end portion which converges from said second predetermined inside diameter to the first predetermined inside diameter; and connecting said end portion between said middle portion and the piping thereby enclosing said collection chamber at a downstream end thereof.

19. The method according to claim 17, wherein said draining step comprises:

orienting said insert and the piping connected thereto in a generally horizontally aspect; and inserting a drain pipe into said collection chamber, said drain pipe being oriented substantially vertical thereby permitting moisture collected by said collection chamber to be drained by gravity.

20. The method according to claim 17, further comprising the step of joining an extraction pipe with the piping immediately upstream of said insert.

* * * * *